US007835669B2

(12) United States Patent
Furukawa et al.

(10) Patent No.: US 7,835,669 B2
(45) Date of Patent: Nov. 16, 2010

(54) CHARGING ROLLER, PROCESS CARTRIDGE AND ELECTROPHOTOGRAPHIC APPARATUS

(75) Inventors: Takumi Furukawa, Susono (JP); Tomohito Taniguchi, Suntou-gun (JP); Hidekazu Matsuda, Susono (JP); Yusuke Yagisawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/704,818

(22) Filed: Feb. 12, 2010

(65) Prior Publication Data

US 2010/0142998 A1 Jun. 10, 2010

Related U.S. Application Data

(63) Continuation of application No. PCT/JP2009/068937, filed on Oct. 29, 2009.

(30) Foreign Application Priority Data

Oct. 31, 2008 (JP) ..... 2008-281599

(51) Int. Cl.
*G03G 15/02* (2006.01)

(52) U.S. Cl. ..... 399/176

(58) Field of Classification Search ..... 399/111, 399/115, 168, 174, 176, 313; 347/140; 430/902; 361/225

See application file for complete search history.

(56) References Cited

U.S. PATENT DOCUMENTS

| | | | |
|---|---|---|---|
| 5,819,142 | A | 10/1998 | Murata et al. |
| 7,054,579 | B2 | 5/2006 | Taniguchi et al. |
| 7,366,448 | B2 | 4/2008 | Taniguchi et al. |
| 2010/0135695 | A1 | 6/2010 | Mayuzumi et al. |

FOREIGN PATENT DOCUMENTS

| | | | |
|---|---|---|---|
| JP | 4-57073 | A | 2/1992 |
| JP | 2001-92221 | A | 4/2001 |
| JP | 2003-162130 | A | 6/2003 |
| JP | 2003-316112 | A | 11/2003 |
| JP | 2004-240357 | A | 8/2004 |
| JP | 2005-37931 | A | 2/2005 |
| JP | 2006-065059 | A | 3/2006 |
| JP | 2006-154442 | A | 6/2006 |
| JP | 2007-127777 | A | 5/2007 |
| JP | 2009-156906 | A | 7/2009 |

*Primary Examiner*—David P Porta
*Assistant Examiner*—Mark R Gaworecki
(74) *Attorney, Agent, or Firm*—Fitzpatrick, Cella, Harper & Scinto

(57) ABSTRACT

The present invention provides a charging roller having a stable chargeability and capable of preventing occurrence of "fogging" on an electrophotographic image. The invention relates to a contact-charging type charging roller which includes a conductive support and a surface layer. The surface layer contains a binder, resin particles containing a carbon black dispersed in the binder, and graphitized particles dispersed in the binder; and the surface layer has, on its surface, convex portions derived from the resin particles, and convex portions derived from the graphitized particles. These convex portions have a specific relationship.

3 Claims, 4 Drawing Sheets

CHARGING ROLLER, PROCESS CARTRIDGE AND ELECTROPHOTOGRAPHIC APPARATUS

CROSS-REFERENCE TO RELATED APPLICATIONS

This application is a continuation of International Application No. PCT/JP2009/068937, filed Oct. 29, 2009, which claims the benefit of Japanese Patent Application No. 2008-281599, filed Oct. 31, 2008.

BACKGROUND OF THE INVENTION

1. Field of the Invention

The present invention relates to a charging roller which charges a subject to be charged by a contact charging method, a process cartridge, and an electrophotographic apparatus.

2. Description of the Related Art

Japanese Patent Application Laid-Open No. 2007-127777 discloses a charging roller having a surface layer containing resin particles which are formed of a resin in which a carbon black is dispersed (hereinafter, also, referred to as "CB-dispersed resin particles").

SUMMARY OF THE INVENTION

The present inventors have studied, based on the conventional technique, a charging roller having a surface layer which contains CB-dispersed resin particles and has, on its surface, convex portions derived from the CB-dispersed resin particles. As a result, the present inventors have found that the CB-dispersed resin particles forming the convex portions easily induce electrostatic discharge because the CB-dispersed resin particles are made conductive by carbon black, and thus such a charging roller exhibits a stable chargeability even if toner and external additives adhere on its surface according to the use thereof. It has also been found that on the other hand, "fogging" can take place on an electrophotographic image formed through a charging step using such a charging roller.

Then, the present invention is directed to providing a charging roller having a stable chargeability and capable of preventing the occurrence of "fogging" on an electrophotographic image. The present invention is also directed to providing a process cartridge and an electrophotographic apparatus each capable of stably offering high-quality electrophotographic images.

A charging roller according to the present invention is a contact charging type charging roller which includes a conductive support, and a surface layer, wherein the surface layer contains a binder, resin particles containing a carbon black dispersed in the binder, and graphitized particles dispersed in the binder; and the surface layer has, on its surface, convex portions derived from the resin particles, and convex portions derived from the graphitized particles, wherein the number of convex portions derived from the graphitized particles having a distance, as a positive value, from a plane surface including each vertex of three convex portions derived from the resin particles adjacent to one convex portion derived from the graphitized particles is 80% or more of the total number of the convex portions derived from the graphitized particles.

An electrophotographic apparatus according to the present invention includes the charging roller and an electrophotographic photosensitive member which is arranged so as to be charged by the charging roller. Further, a process cartridge according to the present invention includes the charging roller, and the electrophotographic photosensitive member, wherein the process cartridge is adapted to be detachably mounted to a main body of an electrophotographic apparatus.

The charging roller of the present invention can prevent the occurrence of lateral steak images due to a charging defect of a photosensitive member, which is caused by extraneous matter attached onto a surface of the charging roller and can prevent degradation of image quality with increased image density. The charging roller of the present invention is capable of stabilizing the discharge property even under application of a large output current load and is suitably used for electrophotographic apparatuses, in which attempts are made to achieve further higher image quality, higher speed performance, and longer lives.

Further features of the present invention will become apparent from the following description of exemplary embodiments with reference to the attached drawings.

DESCRIPTION OF THE EMBODIMENTS

The present inventors have presumed that the mechanism by which "fogging" occurs in an electrophotographic image by using a charging roller having, on its surface, convex portions derived from carbon black (CB) dispersed-resin particles as follows.

Figure 1A:
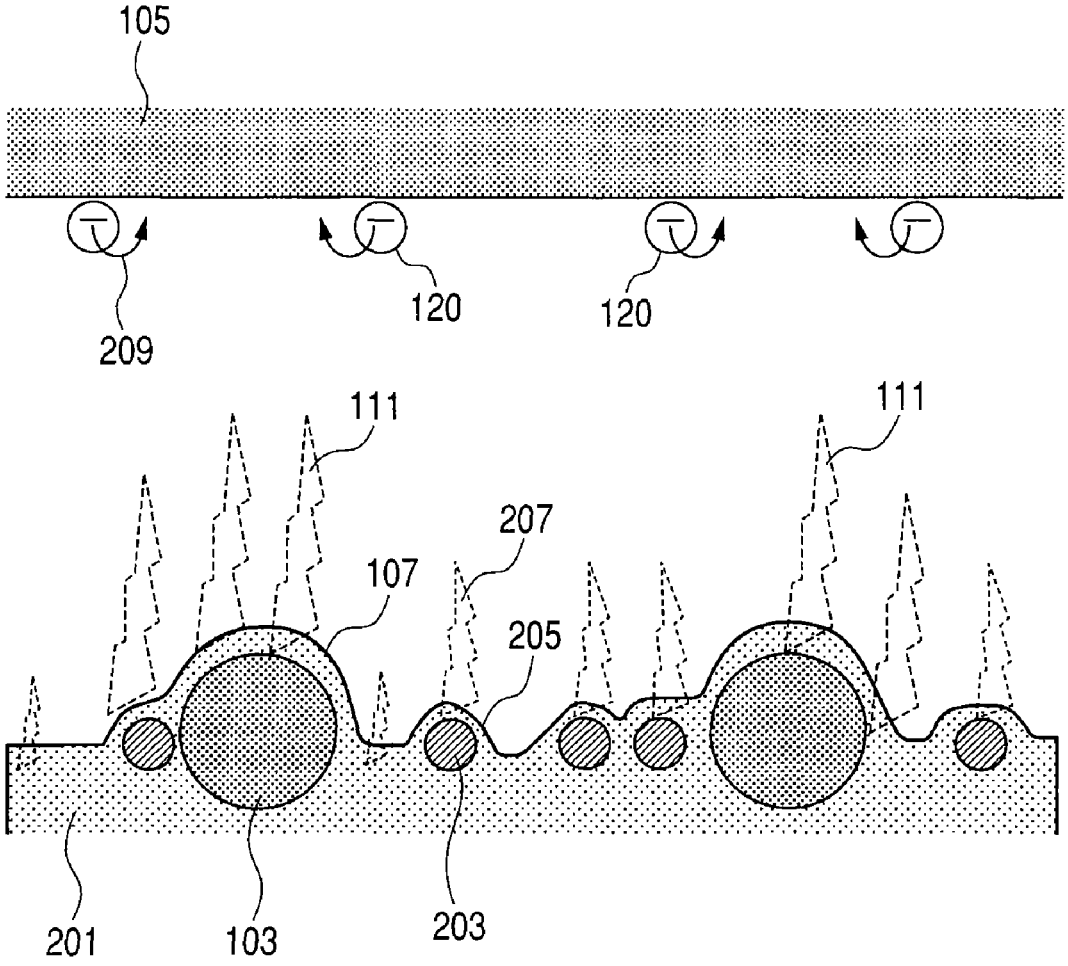
FIGS. 1A and 1B are diagrams illustrating a discharge state in a nip portion between a charging roller and an electrophotographic photosensitive member.
Figure 1B:
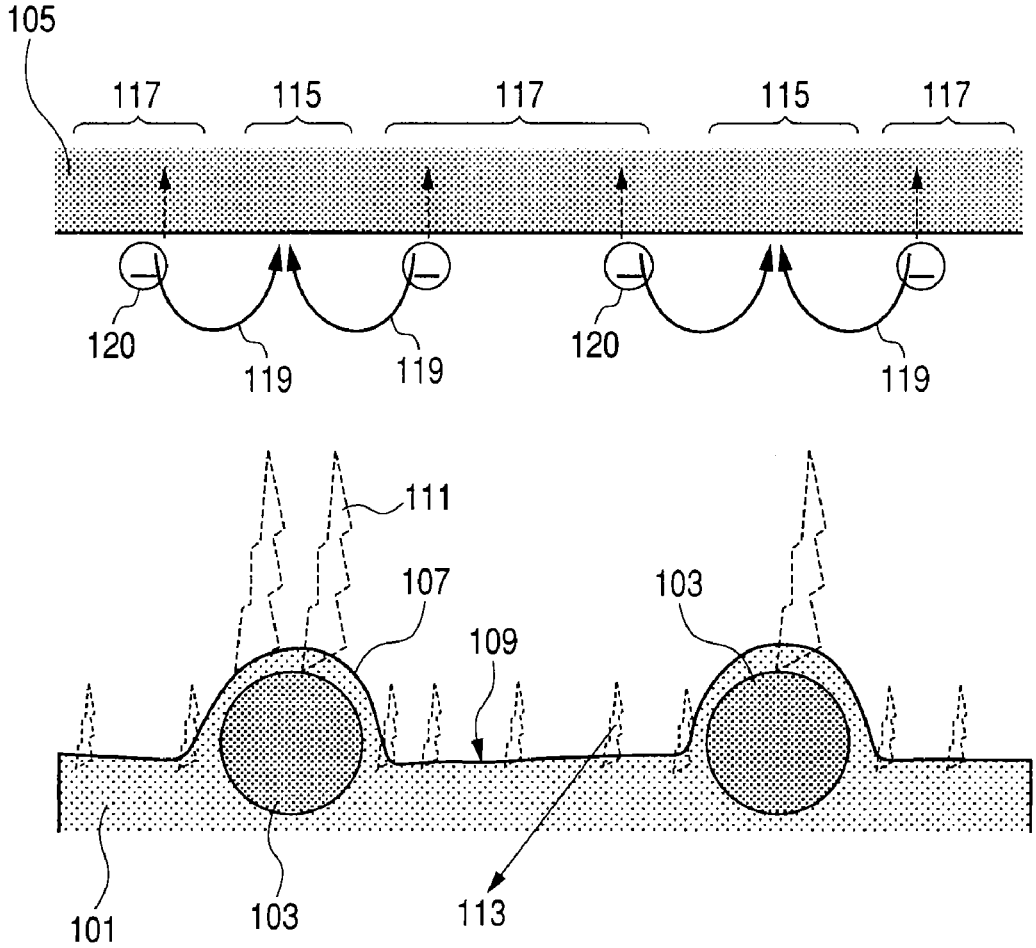

FIG. 1B is a diagram schematically illustrating a discharge state in a nip portion between a charging roller having, on its surface, convex portions derived from CB-dispersed resin particles (hereinafter, also referred to as "CB-dispersed resin particle-derived convex portion(s)"), and an electrophotographic photosensitive member. When a surface layer 101 of an electrophotographic photosensitive member 105 is charged by a charging roller containing CB-dispersed resin particles 103, discharge 111 generated between a CB-dispersed resin particle-derived convex portion 107 and the electrophotographic photosensitive member 105 greatly differs in intensity from discharge 113 generated between a plane portion 109, where no CB-dispersed resin particles 103 are provided, and the electrophotographic photosensitive member 105. Therefore, on a surface of the electrophotographic photosensitive member 105, areas 115 and 117 take place. The area 115 is charged by discharge generated from the CB-dispersed resin particle-derived convex portions on the charging roller, and the area 117 is charged by discharge generated from the plane portion 109 of the surface of the charging roller. Since a great difference in the electrical potential occurs between the area 115 and the area 117, a local electric field 119 is induced between these areas. Under this condition, a toner 120 containing charged particles is trapped by the local electric field 119 to travel along a surface of the electrophotographic photosensitive member. The present inventors considered that due to this traveling of the toner, the toner adheres onto non-latent image portions of the surface of electrophotographic photosensitive member, causing "fogging" in an electrophotographic image.

Based on the presumption, the present inventors thought that it would be possible to prevent "fogging" from adhering onto an electrophotographic photosensitive member by effecting electricity to be stably and appropriately discharged also from a plane portion between two CB-dispersed resin particle-derived convex portions while maintaining suitable discharge generated from the CB-dispersed resin particle-derived convex portions so as to weaken the intensity of the local electric fields generated at the surface of the electrophotographic photosensitive member. To this end, the present inventors produced a charging roller in which convex portions derived from graphitized particles (hereinafter, also referred to as "graphitized particle-derived convex portions") having a height lower than that of the CB-dispersed resin particle-derived convex portions are formed in the plane portion 109. Then, the present inventors studied and examined the chargeability of the thus produced charging roller and "fogging" in electrophotographic images formed using the charging roller. As a result, the present inventors have found that the charging roller has a stable chargeability, and the occurrence of "fogging" is substantially reduced in electrophotographic images formed using the charging roller. The present invention has been accomplished based on the findings.

The reason why the occurrence of "fogging" onto electrophotographic images can be reduced by use of the charging roller of the present invention can be considered as follows. FIG. 1A is a diagram schematically illustrating a discharge phenomenon generated in a nip portion formed between a charging roller according to the present invention and an electrophotographic photosensitive member. A surface layer 201 of the charging roller contains CB-dispersed resin particles 103 and graphitized particles 203 having a higher conductivity than the CB-dispersed resin particles 103. The surface layer 201 has, its surface, the CB-dispersed resin particle-derived convex portions 107, and graphitized particle-derived convex portions 205. Further, the graphitized particle-derived convex portions 205 are basically constructed so as not to come closer to the surface of the electrophotographic photosensitive member 105 than the CB-dispersed resin particle-derived convex portions 107 do. In this case, from the graphitized particle-derived convex portions 205, a discharge 207 is generated which is more intensive than a discharge 113 generating from the plane portion 109 in FIG. 1B toward the electrophotographic photosensitive member, which is not as intensive as a discharge intensity 111 of the CB-dispersed resin particle-derived convex portions 107. Therefore, it is possible to prevent two areas 115 and 117 each having a difference in the electrical potential, as illustrated in FIG. 1B, from being formed in the surface of the electrophotographic photosensitive member 105. That is, it is possible to weaken the intensity of a local electric field 209 which is formed at a surface of the electrophotographic photosensitive member. As a result, it is conceivable that the travel distance of a toner 120 traveling to the non-latent image portions along the surface of the electrophotographic photosensitive member can be made as short as possible, and adhesion of toner onto the non-latent image portions can be suppressed.

Hereinafter, the configuration of the charging roller of the present invention will be further described in detail.

<Conductive Support>

As materials of the conductive support, for example, metals such as iron, copper, stainless steel, aluminum, nickel, and alloys thereof are exemplified.

<Surface Layer>

The surface layer contains a binder and conductive resin particles containing a carbon black dispersed in the binder (CB-dispersed resin particles), and graphitized particles dispersed in the binder. Further, the surface layer has, on its surface, convex portions derived from the CB-dispersed resin particles (CB-dispersed resin particle-derived convex portions), and convex portions derived from the graphitized particles (graphitized particle-derived convex portions).

As to the graphitized particle-derived convex portions, the number of convex portions derived from the graphitized particles having a distance, as a positive value, from a plane surface including each vertex of three convex portions derived from the resin particles adjacent to one convex portion derived from the graphitized particles is 80% or more of the total number of the convex portions derived from the graphitized particles. Here, as for a certain graphitized particle-derived convex portion, the description "having a distance, as "a positive value", from a plane surface including each vertex of three convex portions derived from the resin particles adjacent to the graphitized particle-derived convex portion" is defined as follows. In other words, it means that a vertex of the graphitized particle-derived convex portion is positioned lower than the plane surface including each vertex of three CB-dispersed resin particles-derived convexes adjacent to the graphitized particle-derived convex portion.

One of the technical meanings of employing the above-mentioned configuration is to prevent the graphitized particle-derived convex portions from making contact with the surface of the electrophotographic photosensitive member. More specifically, the graphitized particles are more conductive than the CB-dispersed resin particles. Therefore, when the graphitized particle-derived convex portions directly come in contact with the surface of the electrophotographic photosensitive member, leakage may take place. In order to prevent the graphitized particle-derived convex portions from making contact with the surface of the electrophotographic photosensitive member has a technical meaning for avoiding the occurrence of leakage.

In relation to the definition that the number of graphitized particle-derived convex portions that are not directly contacted with the surface of the electrophotographic photosensitive member is 80% or more of the total number of the graphitized particle-derived convex portions, the value "80%" itself has no critical meaning. It represents a specific numerical value and means that almost or all of the graphitized particle-derived convex portions are not in contact with the surface of the electrophotographic photosensitive member.

Figure 2:
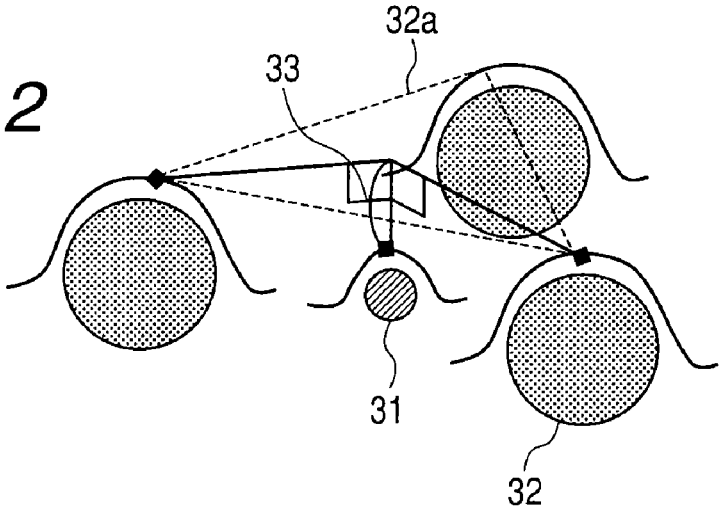
FIG. 2 is a diagram illustrating a surface layer of a charging roller according to the present invention.

The following describes a method of observing a relationship of the height of a graphitized particle-derived convex portion to the height of CB-dispersed resin particles lying around the graphitized particle-derived convex portion. As illustrated in FIG. 2, a laser beam is irradiated to convex portions of the surface layer using a laser microscope (not illustrated) to obtain a reflection spectrum, and graphitized particle-derived convex portion 31 is detected from the reflection spectrum. Then, CB-dispersed resin particle-derived convex portions 32 adjacent to the one graphitized particle-derived convex portion 31 are detected using the laser beam. The description "CB-dispersed resin particle-derived convex portions adjacent to the graphitized particle-derived convex portion 31" means three resin particle-derived convex portions each having a vertex, i.e., three vertexes, lying, in a dimensional distance, in the shortest length to the third shortest length from the vertex of the graphitized particle-derived convex portion. Next, a plane 32*a* including the three vertexes is determined, and a distance 33 between the plane 32*a* and the vertex of the graphitized particle-derived convex portion 31 is determined. Then, a surface (a plane portion) of the surface layer which is not provided with any convex portion is defined as a reference plane, the number of graphitized particle-derived convex portions which are placed, with respect to the reference plane, at a position lower than the plane 32*a* is determined, and a ratio of the number of the graphitized particle-derived convex portions thus determined to the total number of graphitized particle-derived convex portions is calculated. The resulting calculated value is 80% or more. When the ratio of the graphitized particle-derived convex portions that are placed at a position lower than the plane 32*a* is 80% or more, it is possible to prevent high-potential areas caused by high-intensity discharge from being formed on the surface of the electrophotographic photosensitive member, to prevent the occurrence of high-intensity electric field near the electrophotographic photosensitive member, and to prevent the occurrence of increased image density in non-latent image portions.

Hereinafter, a method of measuring graphitized particle-derived convex portions will be further described in detail. First, a surface of the surface layer in a field of view of 0.5 mm×0.5 mm is observed by a laser microscope (trade name: LSM5 PASCAL, manufactured by Carl Zeiss AG). Whether the convex portions in the filed of view are derived from CB-dispersed resin particles or derived from graphitized particles is identified by varying a wavelength of a laser to be excited and examining the given spectrum of the excitation light beam. Then, an x-y plane within the view is scanned with the laser to obtain dimensional image data, and graphitized particle-derived convex portions and CB-dispersed resin particle-derived convex portions are detected from the dimensional image data. Further, the focal point of the laser is moved in a Z-direction, and the scanning is repeated to obtain three-dimensional data. Next, a graphitized particle-derived convex portion is arbitrarily selected, and three CB-dispersed resin particle-derived convex portions adjacent to the graphitized particle-derived convex portion are determined. A distance of a plane including vertexes of the three CB-dispersed resin particle-derived convex portions, being away from vertex of the selected graphitized particle-derived convex portion is calculated from the three-dimensional data. This procedure is carried out for 10 graphitized particles in the field of view. Similarly to the above, the surface of the charging roller in a longitudinal direction is examined to measure for 10-field-of-views at substantially regular intervals. A distance of each vertex of the graphitized particle-derived convex portions in the thus obtained 100 portions in total being away from a plane including three vertexes of CB-dispersed resin particle-derived convex portions was examined. When the number of graphitized particle-derived convex portion is less than 100, the number of field of views is increased, and the measurement is repeated.

When a vertex of a graphitized particle-derived convex portion lies, with respect to the reference plane, lower than the plane including three vertexes of CB-dispersed resin particle-derived convex portions adjacent to the graphitized particle-derived convex portion, the distance is defined as "positive", and when it lies, with respect to the reference plane, upper than the plane, the distance is defined as "negative". The number of the graphitized particle-derived convex portions with this distance being "positive" expressed in percentage is defined as "a ratio of positive graphitized particle-derived convex portions". In the charging member of the present invention, it is necessary that "the ratio of positive graphitized particle-derived convex portions" be set to 80% or more.

The distance between the plane including three vertexes of adjacent CB-dispersed resin particle-derived convex portions and a graphitized particle-derived convex portion whose vertex lies at a position lower than the place is preferably 0.5 μm to 15 μm, more preferably 3 μm to 10 μm. With the distance being in the above range, it is effective to prevent the occurrence of "fogging" in an electrophotographic image because the intensity of a local electric field is reduced.

Preferably, the conductivities in the graphitized particle-derived convex portions and CB-dispersed resin particle-derived convex portions when a voltage of 15V being applied between a surface of the charging roller and the conductive support satisfy inequalities (1), (2) and (3) below.

$$I(C)<I(A)<I(B) \quad (1)$$

$$3 \leqq I(B)/I(A) \leqq 100 \quad (2)$$

$$10\ \text{nA} \leqq I(B) \quad (3)$$

In the above inequalities, I(A) represents an average electric current value in CB-dispersed resin particle-derived convex portions; I(B) represents an average electric current value in graphitized particle-derived convex portions; and I(C) represents an average electric current value in plane portions. As described above, the conductivities are higher in order of the graphitized particle-derived convex portions, CB-dispersed resin particle-derived convex portions, and plane portions. When a voltage 15V is applied thereto, an average electric current value in graphitized particle-derived convex portions is 10 nA or higher, preferably three times or more than and 100 times or less than the average electric current value in the CB-dispersed resin particle-derived convex portions. When the average electric current value in the graphitized particle-derived convex portions is 10 nA or higher, the surface of a photographic photosensitive member can be charged by discharge generated from the graphitized particle-derived convex portions. By satisfying the inequality (2), a properly small amount of discharge is generated from the graphitized particle-derived convex portions, as compared to the discharge from the resin particle-derived convex portions, it is possible to obtain a further advantageous effect of reducing the occurrence of local electric fields across the surface of the electrophotographic photosensitive member, combined with the effect obtained from the heights of these convex portions.

Figure 3:
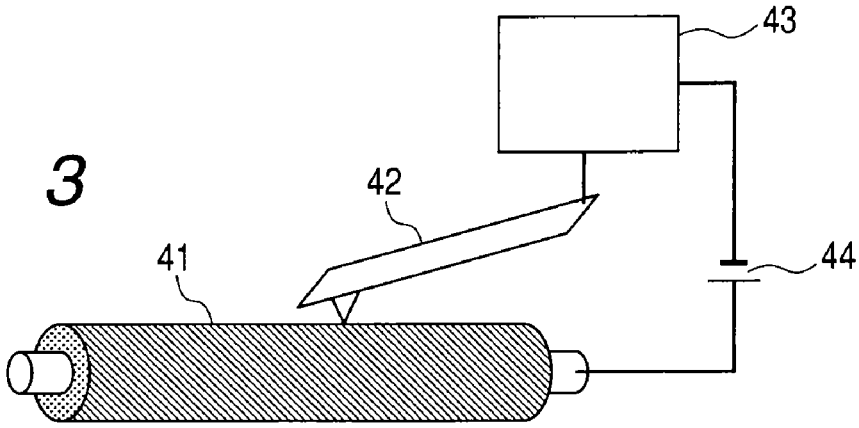
FIG. 3 is a configuration diagram of a conductivity measuring apparatus for a charging roller according to the present invention.

As the conductivities in the graphitized particle-derived convex portions, CB-dispersed resin particle-derived convex portions and plane portions, it is possible to employ conductivities measured, in a conductivity mode, by an atomic force microscope (AFM) (trade name: Q-SCOPE250, manufactured by Quesant instruments Corp.). FIG. 3 is a configuration diagram of a conductivity measuring apparatus for a charging roller according to the present invention. A direct current power source (6614C: manufactured by Agilent Technologies) 44 is connected to a conductive support of a charging roller 41, a voltage of 15V is applied to the conductive support, a free end of a cantilever 42 is brought into contact with a surface layer of the charging roller 41, and an electric current is measured under the conditions shown in Table 1 below. Electric current values at 100 points for the graphitized particle-derived convex portions, resin particle-derived convex portions and plane portions, respectively, are measured with varying the field of view to give an average value. It is desired that the graphitized particle-derived convex portions, CB-dispersed resin particle-derived convex portions and plane portions, as measurement targets, be measured in the same field of view.

TABLE 1

| | |
|---|---|
| Measurement mode | contact(i) |
| Cantilever | CSC17 |
| Measurement range | 80 μm × 80 μm |
| Scan rate | 4 Hz |
| Applied voltage | 15 V |

As each density of the CB-dispersed resin particle-derived convex portions and the graphitized particle-derived convex portions present on the surface of the surface layer in a 0.5 mm-square plane, the number of the CB-dispersed resin particle-derived convex portions is preferably 10 to 1,000, and the number of the graphitized particle-derived convex portions is preferably 100 to 10,000.

The following describes materials constituting the above surface layer.

<<Binder>>

As the binder, a thermosetting resin, thermoplastic resin, rubber, and thermoplastic elastomer can be used. Specific examples thereof include urethane resins, fluororesins, silicone resins, acrylic resins, polyamide resins, butyral resins, styrene-ethylene butylene-olefin copolymers, olefin-ethylene butylene-olefin copolymers. These may be used alone or in combination. Among these, preferred are thermosetting resins for their superiority in releasability to a photosensitive member and resistance to stain.

<<CB (Carbon Black)-Dispersed Resin Particle>>

The CB-dispersed resin particles dispersed in the surface layer are conductive particles comprised of a resin in which a carbon black is dispersed, and forming convex portions, serving as discharge points, on the surface layer. An average particle diameter of the CB-dispersed resin particles is 1 μm to 30 μm, especially 2 μm to 20 μm. Here, as the average particle diameter of the CB-dispersed resin particles in the surface layer, a volume average particle diameter measured by the following method is employed. The surface layer is cut out from arbitrarily selected points over a distance of 500 μm, on a 20 nm basis, by a focused ion beam (FB-2000C, manufactured by Hitachi Ltd.), and cross-sectional images thereof are photographed by an electron microscope. Images taken for the same particle are then combined at 20 nm-intervals, and a stereoscopic particle-shape is calculated. This work is carried out for arbitrarily selected 100 particles from resin particles, and these 100 particles are intended to measure the volume average particle diameter. An equivalent diameter of a sphere having the same volume calculated from the individual stereoscopic particle-shapes obtained is defined as a volume average particle diameter. An average value of volume average particle diameters of all the target particles is defined as an average particle diameter.

In a particle size distribution of the CB-dispersed resin particles, 90% or more of the particles preferably have a particle diameter of from A/5 μm to 5A μm, more preferably from A/3 μm to 3A μm, provided that an average particle diameter of the CB-dispersed resin particles is represented by A μm. When the resin particles have a particle size distribution in the above-range, the intensity of discharge generated from the convex portions derived from the resin particles can be made more uniform. A particle size distribution of such resin particles is a distribution where an average particle diameter A μm is in the above range of volume average particle diameter.

As the particle size distribution of the CB-dispersed resin particles, values calculated for the 100 measurement target particles which have been determined for their stereoscopic particle shapes by the above-mentioned method can be employed.

The closer to a sphere the shape of the CB-dispersed resin particles, the smoother the surface of convex portions formed on a surface of the surface layer, the more difficult extraneous matter accumulates, and thus the more preferred. The ratio of the number of particles having a degree of circularity, as an indicator representing a spherical shape, of 0.9 or higher to the total number of resin particles dispersed in the surface layer is 80% or more. With the ratio of the particles having a degree of circularity 0.9 or higher being 80% or more, it is possible to prevent the occurrence of image nonuniformity like spotted stains resulting from smear of a surface of a charging roller. As the degree of circularity of resin particles dispersed in the surface layer, a value calculated from the following equation can be employed using the measurement results of the 100 particles that have been determined for their stereoscopic particle shapes by the above method.

Degree of circularity=(Circumferential length of a circle having an area identical to that of a projected particle image)/(Circumferential length of the projected particle image)

When the particle has a completely spherical shape, the degree of circularity is 1.000. The more complicated the surface shape, the lower the circularity.

Note that the above-mentioned average particle diameter, particle size distribution and degree of circularity of the CB-dispersed resin particles are values obtained by measuring resin particles which have been dispersed in the surface layer. It is, however, also possible to employ a value obtained by using resin particles before being dispersed in the surface layer. First, 100 resin particles, in which secondarily aggregated particles have been removed so as to be primary particles alone, are observed by a microscope, such as a transmission electron microscope (TEM). The resulting image is analyzed in a computer using image analysis software (Image-Pro Plus, manufactured by Planetron Inc.) to automatically calculate the degree of circularity through a count/size function.

The volume resistivity of the CB-dispersed resin particles is preferably selected in view of the relationship with the volume resistivity of the graphitized particles. A volume resistivity of the CB-dispersed resin particles is $1.0\times10^{12}$ Ω·cm to $1.0\times10^{3}$ Ω·cm, especially $1.0\times10^{8}$ Ω·cm to $1.0\times10^{5}$ Ω·cm. This is because, with the volume resistivity being in the above range, it is possible to form discharge points with which a surface of an electrophotographic photosensitive member can be favorably contact-charged. As the volume resistivity of the CB-dispersed resin particles, it is possible to employ a value measured when a voltage of 10V being applied to a sample under an environment of a temperature of 23° C. and a relative humidity of 50%, using a resistance meter (trade name: LORESTA-GP, manufactured by Mitsubishi Chemical Co., Ltd.). As target samples for measuring the volume resistivity, those compressed by applying a pressure of 10.1 MPa (102 kgf/cm$^2$) can be used.

As a resin constituting the CB-dispersed resin particles, there may be exemplified acrylic resins, polybutadiene resins, polystyrene resins, phenol resins, polyamide resins, nylon resins, fluororesins, silicone resins, epoxy resins, and polyester resins. As a carbon black to be dispersed in the resin, there may be exemplified furnace black, thermal black, acetylene black, and KETJEN BLACK (trade name). As to the average particle diameter, these carbon blacks desirably have a primary particle diameter of 10 nm to 300 nm, because such carbon blacks can be uniformly dispersed in the resin. As the average particle diameter of the carbon black, a value measured according to the following method can be employed. From a cross-sectional image of resin particles photographed, 100 carbon black particles are arbitrarily selected. A projected area of each carbon black particle is determined, and a diameter equivalent to a circle having an area identical to that of the projected particle image is determined, and the result can be regarded as the average particle diameter of the carbon black. On this occasion, only particles having a circle-equivalent diameter in the range of from 5 nm to 500 nm are used for the measurement.

The amount of the carbon black contained in the CB-dispersed resin particles is an amount required to give the above-mentioned volume resistivity to the CB-dispersed resin particles. Generally, it is desired that the amount of the carbon black be suitably adjusted to be in the range of 1 part by mass to 15 parts by mass per 100 parts by mass of resin components of the resin particles. With the amount of the carbon black being in this range, it is possible to give the above-mentioned conductivity as well as a suitable hardness to the CB-dispersed resin particles.

As an example of the method of producing CB-dispersed resin particles, the following methods can be exemplified. There are, for example, a method in which a resin and a carbon black are kneaded so that the carbon black is dispersed in the resin, the dispersed product is cooled to be solidified, pulverized to form particles, the particles are mechanically processed and thermally treated so as to have a spherical shape, and then classified; and a method in which a polymerization initiator, a carbon black and other additives are added to a polymerizable monomer, the monomer composition is suspended, for polymerization, in an aqueous phase containing a dispersion stabilizer by a stirrer so as to have a predetermined particle diameter.

<<Graphitized Particle>>

As the graphitized particles, preferred is a substance which contains carbon atoms forming a laminar structure through $SP^2$ covalent bond and which has a half-value width $\Delta\nu_{1580}$ of a peak derived from graphite at 1,580 $cm^{-1}$ in a Raman spectrum of 80 $cm^{-1}$ or lower. The half-value width $\Delta\nu_{1580}$ is an indicator of the degree of graphitization and an indicator of broadening of graphite surface in its $SP^2$ orbit, resulting in an indicator of the conductivity of graphitized particles. The lower the half-value width $\Delta\nu_{1580}$ is, the higher the degree of graphitization will be, the wider the graphite distribution will be, and the higher the conductivity will be. More preferred range of the half-value width $\Delta\nu_{1580}$ is 30 $cm^{-1}$ to 60 $cm^{-1}$. With the half-value width being in this range, the intensity of local electric fields at the photographic photosensitive member can be reduced as small as possible. As for $\Delta\nu_{1580}$, a value measured under the conditions shown in Table 2 below can be employed.

TABLE 2

| | |
|---|---|
| Measurement sample | Graphitized particles or a graphitized particle at a cross-section of a surface layer |
| Measurement device | Raman spectroscope (trade name: "LabRAM HR", manufactured by HORIBA JOBIN YVON Inc.) |
| Laser | He—Ne laser (peak wavelength: 632 nm) |
| Filter | D0.3 |
| Hole | 1000 μm |
| Slit | 100 μm |
| Mid-spectrum | 1500 $cm^{-1}$ |

TABLE 2-continued

| | |
|---|---|
| Measured time length | 1 second × 16 times |
| Grating | 1800 |
| Objective lens | ×50 |

As the graphitized particles, both natural graphite and artificial graphite can be used. In order to produce artificial graphite, it is possible to use a method of calcining particles of graphite precursor (graphitized particle precursor). The shape and conductivity of resultant graphitized particles can be controlled by selecting the type of graphitized particle precursor and calcination conditions. The shape of the resultant graphitized particles is more or less determined by the shape of the graphitized particle precursor. Specific examples of usable graphitized particle precursor include bulk-mesophase pitch, mesocarbon microbeads, phenol resins, phenol resin coated with mesophase, and coke coated with a pitch. The conductivity of resultant graphitized particles varies depending on the calcination conditions. Generally, graphitized particles obtained by calcination of graphitized particle precursor at higher temperature for a longer period of time will have higher conductivity. Further, the conductivity also varies depending on the chemical bond structure of the graphitized particle precursor used. Since the ease of change in crystallinity, such as hard-graphitization and easy-graphitization, differs depending on the graphitized particle precursor used, the same conductivity could not be obtained even under the same calcination conditions. Specific production methods of the graphitized particles will be described below, however, the graphitized particles used in the present invention are not limited to those obtained by these production methods.

<Graphitized Particle Obtained by Calcination of Coke Coated with Pitch>

Graphitized particles obtained by calcination of coke coated with a pitch can be produced by adding a pitch to coke, molding the resulting product and then calcining the molded product. As the cokes, an oil residue in petroleum distillation, and a crude coke obtained by heating a coal tar pitch at a temperature of about 500° C., and the crude coke further heated at a temperature of 1,200° C. or higher and 1,400° C. or lower can be used. As the pitch, a pitch obtained as a distillation residue of tar can be used.

As a method for obtaining graphitized particles using these raw materials, first, a coke is finely pulverized and mixed with a pitch to prepare a mixture, the mixture is kneaded under application of heat at a temperature of about 150° C., and the kneaded product is molded using a molding machine. The molded product is subjected to heat treatment at a temperature of 700° C. or higher and 1,000° C. or lower to impart thermal stability to the molded product. Next, the molded product is subjected to heat treatment at a temperature of 2,600° C. or higher and 3,000° C. or lower to thereby obtain desired graphitized particles. In the heat treatment, it is desired to cover the molded product with packing-coke in order to avoid the molded product from being oxidized.

<Graphitized Particles Obtained by Calcination of Bulk-Mesophase Pitch>

A bulk-mesophase pitch can be obtained by extracting β-resin from coal-tar pitch by solvent fractionation and hydrogenating the β-resin to carry out heavy-duty treatment. Also, usable is mesophase pitch obtained by finely pulverizing the β-resin after its heavy-duty treatment and then removing the solvent-soluble matter using benzene or toluene. The bulk-mesophase pitch preferably contains 95% by weight or more of quinoline-soluble matter. If a bulk-mesophase pitch containing less than 95% by weight of the same is used, the interiors of particles can not easily be liquid-phase carbonized, and hence may come solid-phase carbonized to form carbonized particles whose shape is kept in a crushed state. In order to make the particles have a shape close to a spherical shape, it is more preferred to control the amount of the quinoline-soluble matter.

As a method for obtaining graphitized particles using the mesophase pitch, the bulk-mesophase pitch is finely pulverized to obtain particles, and the particles obtained are subjected to heat treatment in air at 200° C. or higher and 350° C. or lower to carry out oxidation treatment lightly. This oxidation treatment makes the bulk-mesophase pitch particles infusible only at their surfaces, and the particles are prevented from melting or fusing at the time of heat treatment for graphitization in the subsequent step. The bulk-mesophase pitch particles having been subjected to oxidation treatment may preferably have an oxygen content of from 5% by mass or more and 15% by mass or less. If the oxidized bulk-mesophase pitch particles have an oxygen content of 5% by mass or more, they can be prevented from fusing one another at the time of heat treatment. If the oxidized bulk-mesophase pitch particles have an oxygen content of 15% by mass or less, they can be prevented from being oxidized up to their interiors, and may be graphitized with their shape being in a crushed state, making it possible to obtain spherical particles. Next, the bulk-mesophase pitch particles having been subjected to oxidation treatment are subjected to heat treatment at 1,000° C. or higher and 3,500° C. or lower in an inert atmosphere of nitrogen or argon, thereby obtaining the desired graphitized particles.

<Graphitized Particles Obtained by Calcination of Mesocarbon Microbeads>

As a method for obtaining mesocarbon microbeads, for example, there is, for example, a method in which coal type heavy oil or petroleum type heavy oil is subjected to heat treatment at a temperature of from 300° C. or higher and 500° C. or lower to effect polycondensation to form crude mesocarbon microbeads, then the reaction product is subjected to treatment such as filtration, sedimentation by leaving at rest, or centrifugation, to separate mesocarbon microbeads, and thereafter the mesocarbon microbeads are washed with a solvent such as benzene, toluene or xylene, and further dried to obtain mesocarbon microbeads.

As a method for obtaining graphitized particles using the mesocarbon microbeads, the mesocarbon microbeads having been dried are kept mechanically primarily dispersed by a force mild enough not to break them. This is preferred in order to prevent particles from coalescing after graphitization and to obtain uniform particles. The mesocarbon microbeads having been thus kept primarily dispersed are subjected to primary heat treatment at a temperature of from 200° C. or higher and 1,500° C. or lower in an inert atmosphere to produce a carbonized product. The particles of the carbonized product thus obtained are mechanically dispersed by a force mild enough not to break them. This is preferred in order to prevent particles from coalescing after graphitization and to obtain uniform particles. The carbonized particles having been subjected to secondary dispersion treatment are subjected to secondary heat treatment at a temperature of from 1,000° C. or higher and 3,500° C. or lower in an inert atmosphere, thereby obtaining desired graphitized particles.

In the surface layer of the present invention, it is important to control the height of the CB-dispersed resin particle-derived convex portions and graphitized particle-derived convex portions. A first element for controlling the height of each of the convex portions is the particle diameters of the CB-dispersed resin particles and the graphitized particles. That is, it is necessary for the CB-dispersed resin particles to select an average particle diameter greater than that of the graphitized particle diameter. More specifically, as the CB-dispersed resin particles, it is desired to use their particles having an average particle diameter of 0.5 μm or more, especially 3 μm or more greater than the average particle diameter of the graphitized particles. The upper limit of the difference in average particle diameter between the CB-dispersed resin particles and the graphitized particles is not particularly limited. The difference is, however, practically, 25 μm or less, especially, 15 μm or less.

A second element for controlling the height of each of the convex portions is the preparation method of a surface layer-forming coating for use in formation of the surface layer. More specifically, in the preparation of a surface layer-forming coating, CB-dispersed resin particles and graphitized particles are dispersed in the binder resin. It is important, before/after this dispersion process, to secure the above-mentioned relationship of average particle diameters between the CB-dispersed resin particles and the graphitized particles. Under ordinary conditions for dispersing a filler in a binder for the purpose of effecting uniform dispersion, graphitized particles and CB-dispersed resin particles may undesirably crushed. In particular, graphitized particles are inherently brittle and easily crushed. There are possibilities that the average particle diameter of graphitized particles could be significantly smaller than the original average particle diameter, or, on the contrary, excessively crushed particles could aggregate to each other to exist, as aggregates having a greater average particle diameter, in the surface layer-forming coating. In light of the above, the dispersion conditions are relaxed, such as shortening the dispersion time, to eliminate the possibility as much as possible that the graphitized particles and CB-dispersed resin particles could be crushed in the process of dispersing the graphitized particles and CB-dispersed resin particles in the binder resin to prepare the surface layer-forming coating. More specifically, first, components other than the CB-dispersed resin particles and the graphitized particles, for example, conductive fine particles, are mixed along with glass beads in the binder resin and dispersed over 24 hours to 36 hours, using a paint shaker dispersion machine. Next, CB-dispersed resin particles and graphitized particles are added to the dispersion, and further dispersed. The dispersion time at this stage is one minute to 60 minutes, preferably 5 minutes to 10 minutes. With this, it is possible to prevent the graphitized particles and CB-dispersed resin particles from being crushed and to virtually secure the original relationship of average particle diameters between the CB-dispersed resin particles and the graphitized particles in the surface layer-forming coating.

A third element for controlling the height of each of the convex portions is the thickness of the surface layer. The surface layer can be formed by applying, in a predetermined thickness, a surface layer-forming coating in which a binder resin, CB-dispersed resin particles and graphitized particles are dispersed, onto a support or an elastic layer formed on the support, by a known method. On this occasion, it is desired that the film thickness of the surface layer to the average particle diameter A μm of the CB-dispersed resin particles be A/3 to 10A, especially A/2 to 5A. When the surface layer is made excessively thick, the CB-dispersed resin particles and graphitized particles are embedded in the surface layer, and undesirably convex portions having desired heights may not be formed on the surface layer. With the thickness of the surface layer being in the above range, each of the particle diameters of the CB-dispersed resin particles and the graphitized particles can affect the height of the CB-dispersed resin particle-derived convex portions and the height of the graphitized particle-derived convex portions. Here, the amount of the CB-dispersed resin particles added to the surface layer coating is preferably 2 parts by mass to 80 parts by mass per 100 parts by mass of the binder resin, particularly preferably 5 parts by mass to 40 parts by mass. The amount of the graphitized particles added to the surface layer coating is preferably 0.5 parts by mass to 40 parts by mass per 100 parts by mass of the binder resin, particularly preferably 1 part by mass to 20 parts by mass. Then, a ratio of the addition amount of the CB-dispersed resin particles to the addition amount of the graphitized particles is, in terms of mass ratio, from 0.1 to 10, more preferably from 0.5 to 2. With this, The CB-dispersed resin particle-derived convex portions can be allowed to exist around almost all the graphitized particle-derived convex portions. As a result, for almost all the graphitized particle-derived convex portions, the distance of the graphitized particle-derived convex portions is positive from a plane surface including each vertex of three CB-dispersed resin particle-derived convex portions adjacent to the graphitized particle-derived convex portions. The thickness of the surface layer can be controlled by suitably controlling the solid content, viscosity, and coating speed of the after-mentioned surface layer coating. The higher the solid content, the viscosity and the coating speed of the surface layer coating are, the thicker the film thickness can be. As the values of the film thickness, cross-sections of the surface layer are measured at three points in an axial direction, and three points in a circumferential direction, i.e., nine points in total. The cross-sections are observed by an optical microscope, an electron microscope or the like, and an average value of the measured values can be employed.

As a coating method of the surface layer-forming coating, there are, for example, slit coating, roll coating, ring coating, spray coating, and dip coating. Particularly, when dip coating is employed, the CB-dispersed resin particles and graphitized particles are less likely to be crushed in coating process. For this reason, the original relationship of average diameters between the CB-dispersed resin particle and the graphitized particles is easily secured, and thus dip coating is favorably employed.

The surface layer may contain an ion conductive agent, and an electron conductive agent without departing from the spirit and scope of the appended claims. Further, for the purpose of uniformly improving the electric resistance of the surface layer, controlling the dielectric constant and the coefficient of elasticity thereof, insulating inorganic fine particles may be added to the surface layer. As the inorganic fine particles, particles of silica, and titanium oxide are preferred.

A coating film after applying the surface layer coating is preferably heated, and exposed to ultraviolet ray or an electron beam, or subjected to moisture to accelerate crosslinking, because thereby it is possible to prevent resin particles and graphitized particles contained in the surface layer from falling off.

<<Elastic Layer>>

Figure 4:
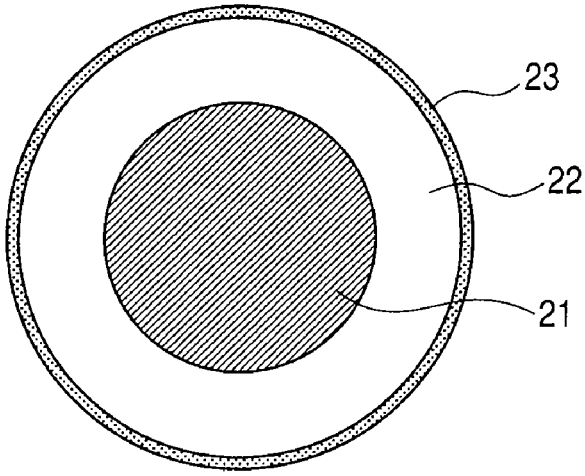
FIG. 4 is a cross-sectional diagram of a charging roller according to the present invention.

The charging roller of the present invention may include layers having other functions, within the range not impairing the functions of the conductive support and the surface layer. By way of example, as illustrated in FIG. 4, there may be exemplified a configuration in which a conductive elastic layer 22 is provided between the conductive support 21 and the surface layer 23.

As a rubber constituting the conductive elastic layer 22, epichlorohydrin rubber, nitrile rubber (NBR), chloroprene rubber, urethane rubber, and silicone rubber are exemplified. As thermoplastic elastomers, styrene-butadiene-styrene-block copolymer (SBS), and styrene-ethylenebutylene-styrene block copolymer (SEBS) are exemplified. Among these, epichlorohydrin rubber is preferably used, because the rubber itself have conductivity of about $1\times10^4$ Ω·cm to about $1\times10^8$ Ω·cm in intermediately resistive regions and can prevent a variation in electric resistance of the conductive elastic layer. Specific examples of the epichlorohydrin rubber include epichlorohydrin (EP) monopolymers, EP-ethylene oxide (EO) copolymers, EP-acryl glycidyl ether (AGE) copolymers, and EP-EO-AGE terpolymers. Among these, particularly preferred are EP-EO-AGE terpolymers, because the conductivity and processability of the conductive elastic layer can be controlled by controlling the polymerization degree and composition ratio of EP-EO-AGE terpolymers, and by using EP-EO-AGE terpolymers, an elastic layer having high mechanical strength and high conductivity can be obtained. In the conductive elastic layer, typical compounding agents can be used within the range not impairing the properties, such as conductivity and mechanical strength, required for the charging roller of the present invention.

As a method of forming an elastic layer, a method can be exemplified in which raw materials of these rubber and elastomer, and compounding agents to be compounded as required are kneaded and then molded. As a method of kneading the raw materials, a method of using a sealed kneader such as a Banbury mixer, intermix mixer, and pressurizing kneader; and a method of using an open kneader such as an open roll can be used. As a method of forming a kneaded product on the conductive support, a molding method, such as an extrusion molding, injection molding, and compression molding can be used. In consideration of working efficiency, cross-head extrusion molding is preferred in which a kneaded product to be formed into an elastic layer is extruded together with the conductive support. As the conductive support, a conductive support coated with an adhesive intended for adhesion with the elastic layer can also be used as required, within the range not losing high conductivity of the conductive support. As the adhesive, thermosetting resins, and thermoplastic resins containing conductive agent are exemplified. Specifically, a urethane resin adhesive, acrylic resin adhesive, polyester resin adhesive, polyether resin adhesive and epoxy resins adhesive can be used. Afterward, when it is necessary to carry out crosslinking of the elastic layer, it is desired that the elastic layer undergo a crosslinking process, such as crosslinking during molding, crosslinking using a vulcanizer, continuous crosslinking, crosslinking by far far/near-infrared radiation, and crosslinking by induction heating. A molded elastic layer may be ground to smooth the surface thereof and to precisely finish the shape thereof. As the grinding method, traverse grinding mode, and wide-width grinding mode can be employed. In the traverse grinding mode, a roller surface is ground by moving a short grindstone along the surface thereof. In contrast, in the wide-width grinding mode, a surface of the elastic layer is ground using a wide-width grindstone, i.e., a grindstone having a width longer than the length of the elastic layer in a short period of time. In terms of the working efficiency, the wide-width grinding mode is preferred.

As the hardness of the elastic layer, it is appropriate for the elastic layer to have a microhardness of from 30° to 80°, more preferably from 45° to 65°. With the hardness of the elastic layer being within the above range, when the charging roller is contacted with a photographic photosensitive member, a distance between a vertex of the resin particle-derived convex portion and a vertex of the graphitized particle-derived convex portion can be maintained at a distance therebetween, in a state where the charging roller is not contacted with the photographic photosensitive member. With this, it is possible to prevent the occurrence of discharge nonuniformity due to the narrow nip width. Here, as the microhardness, a value measured by the following method can be employed. A charging roller, which is left standing in an environment of normal temperature and normal relative humidity (23° C./55% RH) for 12 hours or longer. The charging roller is intended to measure the microhardness by using a micro-area rubber hardness meter (ASKER MD-1: manufactured by Kobunshi Keiki Co., Ltd.) in a 10-N peak hold mode.

The surface of the charging roller of the present invention preferably has such a ten-point average roughness (Rzjis) that a common charging roller has. Specifically, the charging roller has a Rzjis of about 2 μm to about 30 μm and a Sm of about 15 μm to about 150 μm. Concerning the ten-point average roughness (Rzjis) and the average irregularity interval (Sm) of the surface of the charging roller, values determined by a measurement method according to the surface roughness defined in JIS B0601-2001 can be employed. In the surface roughness measurement, a surface roughness meter (SE-3400, manufactured by Kosaka K.K.) can be used. Here, Sm is an average interval measured between 10-point-irregularities (10-point concavo-convexes) in the measurement length. As values of Rzjis and Sm, the charging roller is randomly measured at six portions thereof, and an average value obtained from the measured results can be employed. As the measurement length, a standard measurement length defined in JIS B0601-2001 is used. The electric resistance of the charging roller may be a typical value of a contact type charging roller. More specifically, it is about $1\times10^4\Omega$ to about $1\times10^8\Omega$ in an environment of a temperature of 23° C. and a relative humidity (RH) of 50%.

(Electrophotographic Apparatus)

Figure 5:
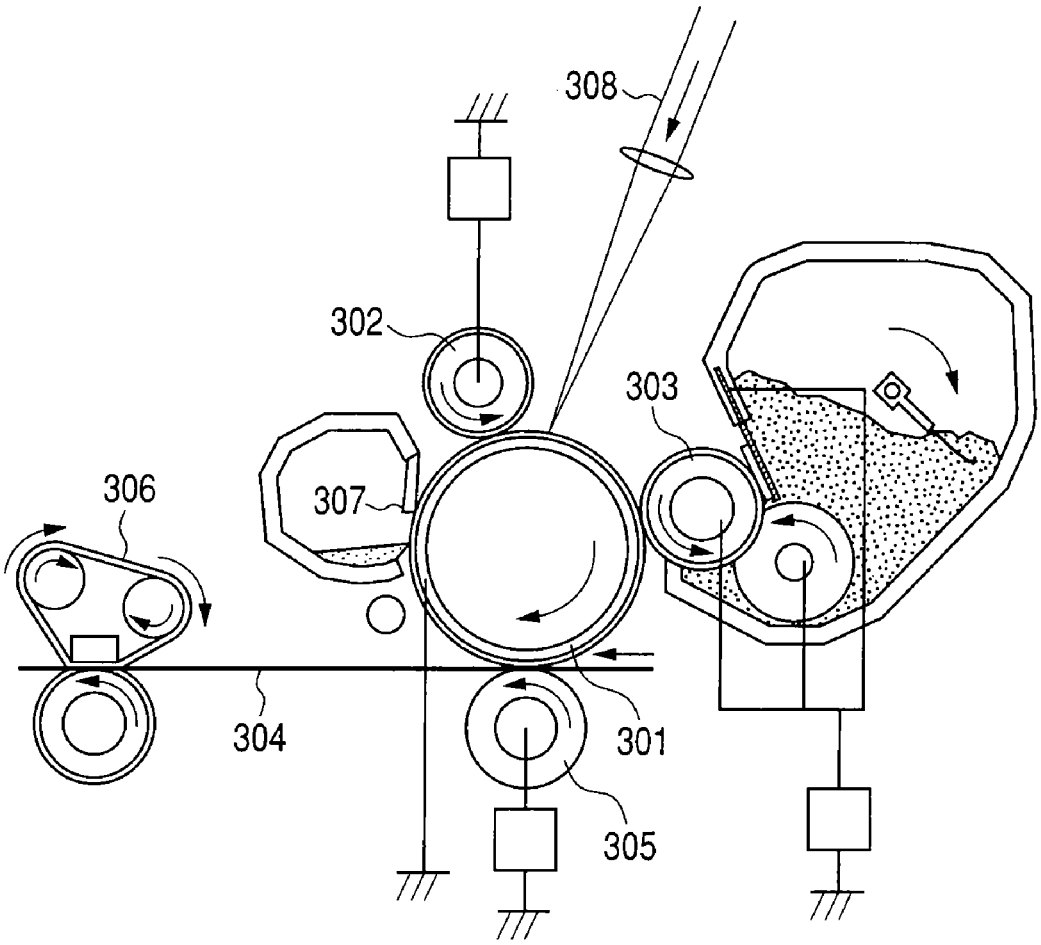
FIG. 5 is a cross-sectional diagram of an electrophotographic apparatus using a charging roller according to the present invention.

FIG. 5 is a cross-sectional diagram of an electrophotographic apparatus using the charging roller of the present invention. The electrophotographic apparatus includes an electrophotographic photosensitive member 301, a charging roller 302 for charging the electrophotographic photosensitive member 301, an exposing device (not illustrated) which emits light 308 for forming a latent image, a developing device 303, a transfer device 305 for transferring an image onto a transfer material 304, a cleaning blade 307, and a fixing device 306. The electrophotographic photosensitive member 301 is of a rotatable drum type and has a photosensitive layer on a conductive support. The electrophotographic photosensitive member 301 is driven to rotate in a direction indicated by an arrow in the drawing, at a predetermined circumferential speed (process speed). The charging roller 302 is pressed by a predetermined pressing force of the electrophotographic photosensitive member 301 so as to be placed in contact therewith. The charging roller 302 is rotated followed by the rotation of the electrophotographic photosensitive member 301 and is adapted to charge the electrophotographic photosensitive member 301 with a predetermined electric potential by applying a direct current voltage from a charging power source 313. As a latent image-forming device for forming a latent image on the electrophotographic photosensitive member 301, for example, an exposing device, such as a laser beam scanner, is used. The uniformly charged electrophotographic photosensitive member 301 is exposed to light correspondingly to image information, thereby forming an electrostatic latent image on the electrophotographic photosensitive member 301. The developing device 303 has a contact type developing roller which is disposed in contact with the electrophotographic photosensitive member 301. A toner which is electrostatically treated so as to have the same polarity as that of the electrophotographic photosensitive member is developed by a reversal processing to form the electrostatic latent image into a visible image. The transfer device 305 has a contact type transfer roller. The toner image is transferred from the electrophotographic photosensitive member 301 onto the transfer material 304 such as plain paper. The cleaning blade 307 mechanically scrapes off and collects untransferred residual toner which remains on the electrophotographic photosensitive member 301. The fixing device 306 is comprised of rolls which have been heated and fix the transferred toner image on the transfer material 304.

Figure 6:
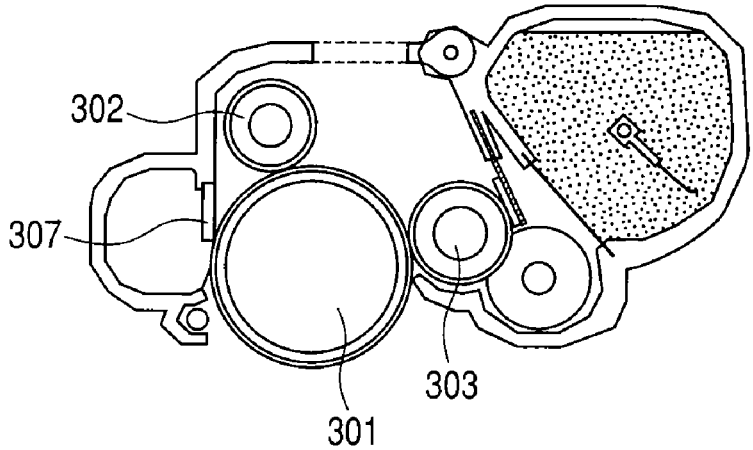
FIG. 6 is a cross-sectional diagram of a process cartridge provided with a charging roller according to the present invention.

FIG. 6 is a cross-sectional diagram of a process cartridge, in which the charging roller 302 of the present invention, the electrophotographic photosensitive member 301, the developing device 303, and the cleaning blade 307 are integrated into one unit, and the process cartridge is adapted to be detachably mounted on a main body of the electrophotographic apparatus.

EXAMPLE

Hereinafter, the present invention will be further described in detail with reference to specific examples.

Graphitized Particle 1

Production Example 1

A β-resin that had been extracted from a coal tar pitch by solvent fractionation was hydrogenated. Next, solvent-soluble matter was removed from the hydrogenated product thus obtained using toluene to yield a bulk-mesophase pitch. The bulk-mesophase pitch was mechanically pulverized so as to have a volume average particle diameter of approximately 3 μm. Afterward, the pulverized product was oxidized by heating to a temperature of 270° C. in the open air at a temperature increase rate of 300° C./h. Subsequently, the product was heated to 3,000° C. in a nitrogen atmosphere at a temperature increase rate of 1,500° C./h and subjected to calcination at a temperature of 3,000° C. for 15 minutes, and then subjected to classification, thereby obtaining Graphitized particle 1.

Graphitized Particle 2

Production Example 2

Phenol resin particles having a volume average particle diameter of 10.0 μm was subjected to air classification to obtain phenol resin particles having a volume average particle diameter of 10.0 μm and a sharp particle size distribution. The phenol resin particles were thermally stabilized in the presence of an oxidizing atmosphere at 300° C. for 1 hour and then calcined at 2,200° C. The resulting particles were subjected to air classification, thereby obtaining Graphitized particle 2.

Graphitized Particle 3

A flake graphite (trade name: X-10, produced by Ito Kokuen K.K.) was prepared as Graphitized particle 3.

Average particle diameters $\Delta\nu_{1580}$ of Graphitized particles 1 to 3 measured by the method described above are shown in Table 3.

TABLE 3

| Graphitized particle No. | Average Particle Diameter (μm) | Δν1580 $cm^{-1}$ |
|---|---|---|
| Graphitized particle 1 | 3.3 | 32 |
| Graphitized particle 2 | 9.8 | 69 |
| Graphitized particle 3 | 10.2 | 18 |

Production of CB-Dispersed Resin Particle 1

Production Example 3

A 2 L-volumetric autoclave, with the atmosphere therein sufficiently replaced with nitrogen gas and dried, was charged with the following materials, and further sufficiently replaced with nitrogen gas from above. Then, the materials were sealed off and mixed with stirring at a temperature of 120° C. for 20 hours to react with each other. Thereafter, unreacted HDI was removed from the reaction product under reduced pressure, and toluene was added to the reaction product to obtain a polyisocyanate prepolymer having a nonvolatile content of 90% by mass.

polyol (ADEKA POLYETHER G-700: produced by Asahi Denka Kogyo K.K.)(hydroxyl value: 225 mg/KOHg): 75 parts by mass hexamethylenediisocyanate (HDI): 100 parts by mass The resulting polyisocyanate prepolymer was found to have an isocyanate content of 8.73% and a viscosity of 1,500 cps (25° C.). Next, the resulting polyisocyanate prepolymer and a carbon black (#3350B: produced by Mitsubishi Chemical Co., Ltd.) (average particle diameter: 24 nm) were placed in water containing a suspension stabilizer (calcium phosphate), and were then mixed and stirred to obtain a suspension. Subsequently, the suspension was heated to initiate a reaction so as to be sufficiently reacted to produce CB-dispersed resin particles. Afterwards, the CB-dispersed resin particles were separated into a liquid phase and a solid phase, and the solid phase was washed to remove the suspension stabilizer adhering on the CB-dispersed resin particles, and was dried, thereby obtaining Resin Particle 1. Resin Particle 1 was found to have an average particle diameter of 5.8 μm.

Production of CB-Dispersed Resin Particles 2 to 8

CB-Dispersed Resin Particles 2 to 8 each having an average particle diameter shown in Table 4 were produced in the same manner as in Production Example 3 except that the mixed amount of the carbon black was changed as shown in the following Table 4, and the concentration of the suspension stabilizer and the number of stirring revolutions were arbitrarily adjusted. Note that the mixed amount of carbon black shown in Table 4 is an amount expressed by part(s) by mass to 100 parts by mass of the polyisocyanate prepolymer.

Production of CB-Dispersed Resin Particle 9

Production Example 4

The following materials were mixed, and dispersed by a viscomill type dispersing machine to obtain Mixture 1. The dispersion was carried out by using, as a dispersion medium, zirconia beads of 0.5 mm in diameter, and setting a circumferential speed to 10 m/s for 60 hours.

methyl methacrylate: 100 parts by mass carbon black (average particle diameter: 28 nm, pH=6.0): 4 parts by mass ethylene glycol dimethacrylate: 0.1 parts by mass benzoyl peroxide: 0.5 parts by mass Meanwhile, the following materials were mixed to prepare Mixture 2.

ion exchanged water: 400 parts by mass polyvinyl alcohol (saponification degree: 85%): 8 parts by mass sodium lauryl sulfate: 0.04 parts by mass Next, Mixture 1 and Mixture 2 were charged into a 2-litter-four-necked flask equipped with a high-speed stirring device (TK-type homomixer, manufactured by PRIMIX Corporation) and dispersed at 13,000 rpm to obtain a dispersion liquid. Then, this dispersion liquid was poured into a polymerization vessel equipped with a stirrer and a thermometer, the atmosphere in the polymerization vessel was replaced with nitrogen gas, and then the dispersion liquid was stirred at 55 rpm, at a reaction temperature of 60° C. for 12 hours to complete suspension polymerization. The resulting reaction product was cooled and then subjected to filtration, washing, drying and classification, thereby obtaining Resin Particle 9.

Production of CB-Dispersed Resin Particles 10 and 11

CB-Dispersed Resin Particles 10 and 11 each having an average particle diameter shown in Table 4 were produced in the same manner as in Production Example 4 except that the mixed amount of the carbon black was changed as shown in the following Table 4, and the number of stirring revolutions was arbitrarily adjusted.

Production of CB-Dispersed Resin Particle 12

Production Example 5

The following materials were kneaded for 2 hours by a sealed mixer.

styrene-dimethylaminoethylmethacrylate-divinylbenzene copolymer (copolymerization ratio=90:10:0.05): 100 parts by mass carbon black (average particle diameter: 122 nm, pH=7.5): 4 parts by mass The resulting kneaded product was cooled, and coarsely crushed by a hammer mill so as to have a particle diameter of 1 mm or smaller. Subsequently, the crushed particles were finely pulverized by a turbo mill (trade name: T-250, manufactured by Turbo Kogyo Co., Ltd.). The circumferential speed of the rotator was set to 115 m/s. Subsequently, the particles were made to have a substantially spherical shape, for 30 minutes, using a hybridizer (manufactured by Nara Machinery Co., Ltd.). Further, the particles were subjected to air classification, thereby obtaining CB-Dispersed Resin Particle 12.

Production of CB-Dispersed Resin Particles 13 and 14

CB-Dispersed Resin Particles 13 and 14 each having an average particle diameter shown in Table 4 were produced in the same manner as in Production Example 5 except that the mixed amount of the carbon black was changed as shown in the following Table 4, and the number of revolutions of the rotator was adjusted.

TABLE 4

| CB-Dispersed Resin Particle | Binder resin | Mixed amount of carbon black (part by mass) | Average particle diameter (μm) |
|---|---|---|---|
| 1 | urethane | 8 | 5.8 |
| 2 | resin | | 10.1 |
| 3 | | | 14 |
| 4 | | 4 | 6.3 |
| 5 | | | 9.9 |
| 6 | | | 13.7 |
| 7 | | 1 | 14.1 |
| 8 | | 15 | 14.2 |
| 9 | acrylic | 8 | 6 |
| 10 | resin | 4 | 13.8 |
| 11 | | 15 | 13.8 |
| 12 | styrene | 8 | 6.1 |
| 13 | resin | 4 | 14 |
| 14 | | 15 | 13.9 |

Preparation of Composite Electronically Conductive Agent

Production Example 6

In 7.0 kg of silica particles (average particle diameter: 15 nm, volume resistivity: $1.8\times10^{12}$ Ω·cm), 140 g of methylhydrogenpolysiloxane was added while operating an edge runner. The components were stirred and mixed for 30 minutes under a linear load of 588N/cm (60 kg/cm). The stirring speed was adjusted to 22 rpm. In the resulting mixture, 7.0 kg of carbon black particles (average particle diameter: 28 nm, volume resistivity: $1.0\times10^{2}$ Ω·cm) were added over 10 minutes, while operating an edge runner, and further stirred and mixed for 60 minutes under a linear load of 588N/cm (60 kg/cm) to make the carbon black particles adhered on surfaces of silica particles coated with methylhydrogenpolysiloxane. Afterward, the resulting particles were dried at 80° C. for 60 minutes using a dryer to obtain a composite electronically conductive agent. The stirring speed was adjusted to 22 rpm. The resulting composite electronically conductive agent was found to have an average particle diameter of 47 nm and a volume resistivity of $2.3\times10^{2}$ Ω·cm.

Preparation of Surface-Treated Titanium Oxide Fine Particle

Production Example 7

In 1,000 g of acicular rutile type titanium oxide particles (average particle diameter: 15 nm, volume resistivity: $5.2\times10^{10}$ Ω·cm), 110 g of isobutyltrimethoxysilane as a surface treatment agent, and 3,000 g of toluene as a solvent were mixed to prepare a slurry. The slurry was mixed for 30 minutes by a stirrer and then supplied to a visco mill filled with glass beads having an average particle diameter of 0.8 mm in an amount of 80% of the effective internal volume of the visco mill. The slurry was wet pulverized at a temperature of 35° C.±5° C. The slurry obtained by the wet pulverization was subjected to distillation under reduced pressure to remove the toluene therefrom, and the surface treatment agent was baked at 120° C. for 2 hours. The baked particles were cooled to room temperature, and pulverized by a pin mill, thereby obtaining surface-treated titanium oxide fine particles having an average particle diameter of 17 nm.

Production of Elastic Layer

Production Example 8

An iron cylindrical body having a diameter of 6 mm and a length of 252.5 mm was coated with a thermosetting adhesive (trade name: METALOCK U-20, produced by Toyo Kagaku Kenkyusho Co., Ltd.) and dried, and the cylindrical body was used as a conductive support.

The following materials were kneaded for 10 minutes by a sealed mixer whose inside temperature was set to 50° C. to prepare a raw-material compound.

epichlorohydrin rubber (EO-EP-AGC terpolymer, EO/EP/AGE=73 mol %/23 mol %/4 mol %): 100 parts by mass calcium carbonate: 60 parts by mass aliphatic polyester plasticizer: 8 parts by mass zinc stearate: 1 part by mass 2-mercaptobenzimidazole (MB) (antioxidant): 0.5 parts by mass, zinc oxide: 2 parts by mass quaternary ammonium salt: 1.5 parts by mass carbon black (average particle diameter: 100 nm, volume resistivity: 0.1 Ω·cm): 5 parts by mass The following materials were added to the resulting raw-material compound, and kneaded for 10 minutes by an open roll which had been cooled to 20° C. to obtain a conductive elastic layer compound.

sulfur: 1 part by mass dibenzothiazyl sulfide (DM): 1 part by mass tetramethylthiuram monosulfide (TS): 0.5 parts by mass The conductive elastic layer compound was extruded together with the conductive support through a cross-head extruder so as to be molded in the form of a roller having an external diameter of about 9 mm. Next, the molded conductive support was heated in an electric oven, the temperature thereof being maintained at 160° C. for 1 hour to vulcanize the rubber and make the adhesive crosslinked. Both ends of the rubber were cut off so that the conductive support was exposed out of the rubber, and the length of the conductive elastic layer was 228 mm. Subsequently, the surface of the conductive support was ground so as to be formed in a roller having an external diameter of 8.5 mm, thereby obtaining an elastic layer.

Preparation of Coating Material 1

Production Example 9

The following materials were placed together with glass beads having an average particle diameter of 0.8 mm in a glass bottle and dispersed for 60 hours using a paint-shaker dispersing device to prepare Coating material 1.

caprolactone-modified acrylic polyol solution (trade name: PLACCEL DC2016, produced by Daicel Chemical Industries, Ltd.) (solid content: 70% by mass): 100 parts by mass block isocyanate IPDI (trade name: VESTANAT B1370, produced by Degussa HULS AG): 22.5 parts by mass block isocyanate HDI (trade name: DURANATE TPA-B80E, produced by Asahi Chemical Industry Co., Ltd.): 33.6 parts by mass composite electronically conductive agent (produced in Production Example 6): 35 parts by mass surface-treated titanium oxide fine particles (produced by Production Example 7): 21 parts by mass modified-dimethylsilicone oil (trade name: SH28PA, TORAY Dow Corning Silicone Co., Ltd.): 0.16 parts by mass methylisobutylketone (MIBK): 328 parts by mass Preparation of Coating Material 2

Production Example 10

The following materials were placed together with glass beads having an average particle diameter of 0.8 mm in a glass bottle and dispersed for 60 hours using a paint-shaker dispersing device to prepare Coating material 2.

trifunctional acrylate monomer (trade name: SR-454, produced by Nippon Kayaku Co., Ltd.): 90 parts by mass silane coupling agent (KBM-5103, produced by Shin-Etsu Chemical Co., Ltd.): 10 parts by mass composite electronically conductive agent (produced in Production Example 6): 50 parts by mass surface-treated titanium oxide fine particles (produced in Production Example 7): 30 parts by mass MIBK: 488 parts by mass Preparation of Coating Material 3

Production Example 11

The following materials were placed together with glass beads having an average particle diameter of 0.8 mm in a glass bottle and dispersed for 60 hours using a paint-shaker dispersing device to prepare Coating material 3.

fluorine resin dispersion (tetrafluoroethylene-perfluoroalkyl vinyl ether copolymer (PFA)) (trade name: AD-2CR aqueous dispersion, produced by Daikin Industries Ltd.) (concentration of solid content=45% by mass to 50% by mass; specific gravity=1.4; viscosity (25° C.)=250 mPa·s to 500 mPa·s): 200 parts by mass composite electronically conductive agent (produced in Production Example 6): 50 parts by mass surface-treated titanium oxide fine particles (produced in Production Example 7): 30 parts by mass pure water: 488 parts by mass Preparation of Coating Material 4

Coating material 4 was produced in the same manner as in Production Example 9 except that in the preparation of Coating material 1 in Production Example 9, the amount of the composite electronically conductive agent was changed to 14 parts by mass.

Preparation of Coating Material 5

Coating material 5 was produced in the same manner as in Production Example 9 except that in the preparation of Coating material 1 in Production Example 9, the amount of the composite electronically conductive agent was changed to 49 parts by mass.

Preparation of Coating Material 6

Coating material 6 was produced in the same manner as in Production Example 9 except that in the preparation of Coating material 1 in Production Example 9, the amount of the MIBK was changed to 220 parts by mass.

Preparation of Coating Material 7

Coating material 7 was produced in the same manner as in Production Example 9 except that in the preparation of Coating material 1 in Production Example 9, the amount of the MIBK was changed to 616 parts by mass.

Example 1

After the following materials were added in Coating material 1, the materials were dispersed for 5 minutes by a paint-shaker dispersing device, and the glass beads were filtered out therefrom to obtain Surface Layer Coating material A.

Graphitized particle 1: 3 parts by mass

CB-dispersed resin particles 1: 6 parts by mass

CB-dispersed resin particles 6: 6 parts by mass

Surface Layer Coating material A was applied to a surface of the elastic layer formed in Production Example 8, by dip coating. Afterward, the coating was air dried at normal temperature for 30 minutes or more, heated in an electric oven at a temperature of 80° C. for 1 hour and further heated at 160° C. for 1 hour to make a film of Surface Layer Coating material A crosslinked, thereby forming a surface layer of 11.6 μm in thickness. By the above-described procedure, a charging roller having an elastic layer and a surface layer on a conductive support was obtained. As to the resulting charging roller, electric current values of I (A), I (B), and I (C) were measured by AFM. Also, a ratio of the number of graphitized particle-derived convex portions having a distance, as "a positive value", from a plane surface including each vertex of convex portions derived from three CB-dispersed resin particle-derived convex portions adjacent to graphitized particle-derived convex portions to the total number of graphitized particle-derived convex portions was determined. The measurement results are shown in Table 6.

<Evaluation of "Image Fogging" in Non-Latent Image Portion>

Image formation was carried out using the resulting charging roller in the following manner to evaluate the image formed. Specifically, an electrophotographic apparatus (LBP5400, manufactured by Canon Inc.) was remodeled so that the output speed of a recording medium was 200 mm/sec, and the charging roller thus produced was attached to a black cartridge in the remodeled machine. An entire-blank image was output after setting $V_{back}$ (a voltage obtained by subtracting a voltage applied to a developing roller from a surface potential of the electrophotographic photosensitive member) to −20V and −70V. Since the toner placed in the electrophotographic apparatus is a negatively chargeable toner, the value of $V_{back}$ is usually set to about −70V to about −150V. With the voltage of $V_{back}$ being set to −20V and −70V, the toner is not developed on a surface of the electrophotographic photosensitive member under normal circumstances. Setting of $V_{back}$ to −20V was employed because this voltage setting correlates to the image density of non-latent image portions at from about −70V to about −150V, and a difference of image density in non-latent image portions can be clearly discriminated. It is presumed that a toner developed under this condition is developed because the toner is trapped by local electric fields across the surface of the electrophotographic photosensitive member due to nonuniformity of potential on the electrophotographic photosensitive member, which is produced by nonuniform discharge of a charging roller. The image was output by the remodeled machine thus configured, under an environment of a temperature of 15° C. and a relative humidity of 10%. The degree of whiteness of the image output when setting the $V_{back}$ to −20V was measured using a whiteness photometer (trade name: TC-6DS/A, produced by Tokyo Denshoku Co., Ltd.) according to the method defined in JIS P8148. A difference in degree of whiteness indicating a degree of increased image density in non-latent image portions was calculated by subtracting the average value of five points of degree of whiteness of paper sheets after the image output, from the average value of five points of degree of whiteness of paper sheets before the image output.

Meanwhile, as to the degree of whiteness of the image output when setting the $V_{back}$ to −70V, a difference in image density before/after image output was visually observed and evaluated according to the following criteria. The results are shown in Table 6.

A: lower than 2.0% (A difference in image density before and after image output cannot be distinguished.)

B: equal to or higher than 2.0% and lower than 5.0% (It can be distinguished that the image density after image output is very slightly higher than the image density before image output.)

C: equal to or higher than 5.0% and lower than 7.0% (It can be distinguished that the image density after image output is slightly higher than the image density before image output.)

D: 7.0% or higher (It can be clearly distinguished that the image density after image output is higher than the image density before image output.)

<Image Nonuniformity Due to Streak Running in the Lateral Direction>

Image output was carried out in the same manner as in the measurement of the degree of increased image density in non-latent image portions except that the image output conditions were changed to the following conditions. A sheet of image was output using an image randomly printed at 1% area of an image formation area of A4-size paper, the operation of the electrophotographic apparatus was stopped, and 10 seconds later, the image forming operation was restarted. This operation was repeated, and 30,000 sheets of electrophotographic images were formed. Thereafter, electrophotographic images for evaluation were formed. The electrophotographic images for evaluation were halftone images (an image with an intermediate image density, which is a one-dot-width horizontal line in two-dot intervals was drawn in a direction perpendicular to the rotational direction of the electrophotographic photosensitive member). Printed images were evaluated according to the following criteria. The results are shown in Table 6.

A: Image nonuniformity due to a streak running in the lateral direction is not observed.

B: Image nonuniformity due to a streak running in the lateral direction in short length (shorter than 1 mm) is observed, but no problem in practical use.

C: Image nonuniformity due to a streak running in the lateral direction in long length (from several mm to several cm) is observed.

Examples 2 to 16, Comparative Examples 1 and 2

Surface layer-forming coatings were prepared in the same manner as in Example 1 except that the Coating material, Graphitized particle, and CB-dispersed resin particle were changed to those shown in Table 5 below. Charging rollers were produced using these surface layer-forming coatings in the same manner as in Example 1. Each of the resulting charging rollers was evaluated in the same manner as in Example 1. The evaluation results are shown in Table 6 below.

TABLE 5

| | Coating | Graphitized particle | | | CB-Dispersed Resin Particle | | | | | | | |
|---|---|---|---|---|---|---|---|---|---|---|---|---|
| | material | 1 | 2 | 3 | 1 | 2 | 3 | 4 | 5 | 6 | 7 | 8 |
| | No. | Mixed amount (part by mass) | | | Mixed amount (part by mass) | | | | | | | |
| Example 1 | 1 | 3 | | | 6 | | | | | 6 | | |
| 2 | 1 | 3 | | | | 6 | | | 6 | | | |
| 3 | 1 | 3 | | | | | | 6 | | 6 | | |
| 4 | 1 | 3 | | | | | | | | 6 | | |
| 5 | 1 | 3 | | | | | | | 6 | | | |
| 6 | 1 | 3 | | | | | | 6 | | | | |
| 7 | 1 | 3 | | | | | 6 | | | | | |
| 8 | 1 | 3 | | | | | | | | | 6 | |
| 9 | 1 | 3 | | | | | | | | | | 6 |
| 10 | 4 | 3 | | | | | | | | 6 | | |
| 11 | 5 | | 3 | | | | | | | 6 | | |
| 12 | 6 | 3 | | | | | | | | 6 | | |
| 13 | 1 | | | 3 | | | | | | 6 | | |
| 14 | 7 | | 3 | | | | | | | 6 | | |
| 15 | 1 | | 3 | | | | | | | | | 6 |
| 16 | 1 | | 3 | | | | | | | | 6 | |
| Comparative Example 1 | 1 | | | | | | | | | 6 | | |
| 2 | 1 | | | 3 | | | | 6 | | | | |

TABLE 6

| | Ratio of graphitized particle-derived convex portions having "positive" distance (%) | Thickness of surface layer (μm) | Electric current measured by AFM I(A) nA | I(B) nA | I(C) nA | I(B)/I(A) | Evaluation of "fogging" degree of whiteness (%) | Grade | Image nonuniformity due to astreak running in the lateral direction Grade |
|---|---|---|---|---|---|---|---|---|---|
| Example 1 | 93 | 11.6 | 1.16 | 37.21 | 0.06 | 32 | 0.8 | A | A |
| 2 | 94 | 12.3 | 1.29 | 25.88 | 0.08 | 20 | 1.5 | A | A |
| 3 | 91 | 11.5 | 1.15 | 42.43 | 0.15 | 37 | 1.9 | B | A |
| 4 | 85 | 14.5 | 0.78 | 25.98 | 0.20 | 32 | 3.4 | B | A |
| 5 | 88 | 12.2 | 0.61 | 17.79 | 0.10 | 29 | 2.9 | B | A |
| 6 | 82 | 14.5 | 0.71 | 14.87 | 0.22 | 21 | 2.6 | B | B |
| 7 | 89 | 13.6 | 3.55 | 28.38 | 0.05 | 8 | 3.6 | B | A |
| 8 | 88 | 14.3 | 0.38 | 34.87 | 0.11 | 92 | 3.1 | B | B |
| 9 | 90 | 12.0 | 9.81 | 39.25 | 0.23 | 4 | 4.2 | B | A |
| 10 | 86 | 7.7 | 0.15 | 13.21 | 0.07 | 87 | 3.7 | B | A |
| 11 | 84 | 15.3 | 2.39 | 11.97 | 0.16 | 5 | 2.8 | C | A |
| 12 | 86 | 20.4 | 0.43 | 5.95 | 0.01 | 14 | 5.3 | C | A |
| 13 | 87 | 11.6 | 0.68 | 83.18 | 0.15 | 122 | 6.2 | C | A |
| 14 | 93 | 6.7 | 8.38 | 16.75 | 0.48 | 2 | 5.5 | C | A |
| 15 | 85 | 13.5 | 3.50 | 7.46 | 0.23 | 2 | 6.6 | C | A |
| 16 | 83 | 11.8 | 0.08 | 8.81 | 0.05 | 108 | 6.9 | D | B |
| Comparative Example 1 | — | 12.2 | 1.50 | — | 0.07 | — | 14.3 | | A |
| 2 | 13 | 13.0 | 0.60 | 79.82 | 0.20 | 133 | 10.7 | | A |

Example 17

After the following materials were added in Coating material 2, the materials were dispersed for 5 minutes by a paint-shaker dispersing device, and the glass beads were filtered out therefrom to obtain Surface Layer Coating material B.

Graphitized particle 1: 3 parts by mass

CB-dispersed resin particles 1: 6 parts by mass

CB-dispersed resin particles 6: 6 parts by mass

Surface Layer Coating material B was applied to a surface of the elastic layer formed in Production Example 8, by ring coating. Afterward, the Surface Layer Coating material B was crosslinked using an electron-beam irradiating device (ELECTOROBEAM-C EC150/45/40 mA, manufactured by Iwasaki Denki K.K.), thereby obtaining a charging roller. More specifically, an electron beam was irradiated at an acceleration voltage of 150 kV, a radiation dose of 1,200 kGy, and an oxygen concentration of 300 ppm or lower. The resulting charging roller was evaluated in the same manner as in Example 1. The evaluation results are shown in Table 8.

Example 18 and 19

Surface layer-forming coatings were prepared in the same manner as in Example 17 except that the Coating material, Graphitized particle, and CB-dispersed resin particle were changed to those shown in Table 7 below. Charging rollers were produced using these surface layer-forming coatings in the same manner as in Example 17. Each of the resulting charging rollers was evaluated in the same manner as in Example 17. The evaluation results are shown in Table 8 below.

Example 20

After the following materials were added relative to 200 parts by mass of the fluorine resin dispersion, in Coating material 3, the materials were dispersed for 5 minutes by a paint-shaker dispersing device, and the glass beads were filtered out therefrom to obtain Surface Layer Coating material C.

Graphitized particle 1: 3 parts by mass

CB-dispersed resin particles 1: 6 parts by mass

CB-dispersed resin particles 6: 6 parts by mass

Surface Layer Coating material C was applied to a surface of the elastic layer by spray coating. Afterward, the Surface Layer Coating material C was heated at 320° C. for 40 minutes, thereby obtaining a charging roller. The resulting charging roller was evaluated in the same manner as in Example 1. The evaluation results are shown in Table 8.

Examples 21 and 22

Surface layer-forming coatings were prepared in the same manner as in Example 20 except that the Coating material, Graphitized particle, and CB-dispersed resin particle were changed to those shown in Table 7 below. Charging rollers were produced using these surface layer-forming coatings in the same manner as in Example 20. Each of the resulting charging rollers was evaluated in the same manner as in Example 20. The evaluation results are shown in Table 8 below.

TABLE 7

| | Coating material No. | Graphitized particle 1 | 2 | 3 | CB-Dispersed Resin Particle 1 | 2 | 3 | 4 | 5 | 6 | 7 | 8 |
|---|---|---|---|---|---|---|---|---|---|---|---|---|
| | | Mixed amount (part by mass) | | | Mixed amount (part by mass) | | | | | | | |
| Example 17 | 2 | 3 | | | 6 | | | | | 6 | | |
| 18 | 2 | 3 | | | | | | | | 6 | | |
| 19 | 2 | | 3 | | | | | | | | | 6 |
| 20 | 3 | 3 | | | 6 | | | | | 6 | | |
| 21 | 3 | 3 | | | | | | | | 6 | | |
| 22 | 3 | | 3 | | | | | | | | | 6 |

TABLE 8

| | Ratio of graphitized particle-derived convex portions having "positive" distance (%) | Thickness of surface layer (μm) | Electric current measured by AFM I(A) nA | I(B) nA | I(C) nA | I(B)/I(A) | Evaluation of "fogging" Degree of whiteness (%) | Grade | Image nonuniformity due to streak running in the lateral direction Grade |
|---|---|---|---|---|---|---|---|---|---|
| Example 17 | 88 | 9.2 | 1.39 | 44.42 | 0.07 | 32 | 1.1 | A | A |
| 18 | 88 | 10.0 | 0.63 | 22.55 | 0.16 | 36 | 4.0 | B | A |
| 19 | 82 | 9.3 | 2.88 | 50.12 | 0.25 | 17 | 6.7 | C | A |
| 20 | 90 | 18.3 | 1.16 | 33.30 | 0.07 | 29 | 1.8 | A | A |
| 21 | 87 | 19.0 | 0.86 | 27.54 | 0.18 | 32 | 4.2 | B | A |
| 22 | 84 | 17.6 | 2.85 | 6.33 | 0.25 | 2 | 6.9 | C | A |

Examples 23 and 28

Surface layer-forming coatings were prepared in the same manner as in Example 1 except that the Graphitized particle, and CB-dispersed resin particle were changed to those shown in Table 9 below. Charging rollers were produced using these surface layer-forming coatings in the same manner as in Example 1. Each of the resulting charging rollers was evaluated in the same manner as in Example 1. The evaluation results are shown in Table 10 below.

TABLE 9

| | Coating material No. | Graphitized particle 1 | 2 | 3 | CB-Dispersed Resin Particle 9 | 10 | 11 | 12 | 13 | 14 |
|---|---|---|---|---|---|---|---|---|---|---|
| | | Mixed amount (part by mass) | | | | Mixed amount (part by mass) | | | | |
| Example 23 | 1 | 3 | | | 6 | 6 | | | | |
| 24 | 1 | 3 | | | | 6 | | | | |

TABLE 9-continued

| | Coating material No. | Graphitized particle 1 | 2 | 3 | CB-Dispersed Resin Particle 9 | 10 | 11 | 12 | 13 | 14 |
|---|---|---|---|---|---|---|---|---|---|---|
| | | Mixed amount (part by mass) | | | | Mixed amount (part by mass) | | | | |
| 25 | 1 | | 3 | | | 6 | | | | |
| 26 | 1 | 3 | | | | | | 6 | 6 | |
| 27 | 1 | 3 | | | | | | | 6 | |
| 28 | 1 | | 3 | | | | | | | 6 |

TABLE 10

| | Ratio of graphitized particle-derived convex portions having "positive" distance (%) | Thickness of surface layer (μm) | Electric current measured by AFM I(A) nA | I(B) nA | I(C) nA | I(B)/I(A) | Evaluation of "fogging" Degree of whiteness (%) | Grade | Image nonuniformity due to streak running in the lateral direction Grade |
|---|---|---|---|---|---|---|---|---|---|
| Example 23 | 94 | 13.7 | 1.16 | 33.37 | 0.05 | 29 | 0.9 | A | A |
| 24 | 89 | 13.6 | 0.78 | 20.84 | 0.16 | 27 | 3.8 | B | A |
| 25 | 92 | 12.2 | 3.85 | 7.77 | 0.23 | 2 | 5.9 | C | A |
| 26 | 92 | 12.6 | 0.93 | 37.59 | 0.07 | 41 | 1.2 | A | A |
| 27 | 88 | 12.8 | 0.94 | 27.56 | 0.22 | 29 | 3.2 | B | A |
| 28 | 84 | 13.2 | 4.20 | 5.63 | 0.18 | 1 | 6.0 | C | A |

The comparison results of "degree of whiteness" between Examples and Comparative Examples shown in Tables 6, 8, and 10 above demonstrated that with use of the charging roller of the present invention, an effect of preventing the occurrence of "fogging" of electrophotographic images can be improved about 50% or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This patent application claims a priority from Japanese Patent Application No. 2008-281599 filed on Oct. 31, 2008, the disclosure of which are incorporated herein by reference.

What is claimed is:

1. A charging roller comprising: a conductive support, and a surface layer, wherein the surface layer comprises a binder, resin particles containing a carbon black dispersed in the binder, and graphitized particles dispersed in the binder; and the surface layer has, on its surface, convex portions derived from the resin particles, and convex portions derived from the graphitized particles, wherein the number of convex portions derived from the graphitized particles having a distance, as a positive value, from a plane surface including each vertex of three convex portions derived from the resin particles adjacent to one convex portion derived from the graphitized particles is 80% or more of the total number of the convex portions derived from the graphitized particles.

2. An electrophotographic apparatus comprising: a charging roller according to claim 1, and an electrophotographic photosensitive member.

3. A process cartridge comprising: a charging roller according to claim 1, and an electrophotographic photosensitive member, wherein the process cartridge is adapted to be detachably mounted on a main body of an electrophotographic apparatus.

* * * * *